US007129896B2

(12) United States Patent
Iizuka et al.

(10) Patent No.: US 7,129,896 B2
(45) Date of Patent: Oct. 31, 2006

(54) COMPACT ANTENNA DEVICE

(75) Inventors: Takeshi Iizuka, Akita (JP); Kanenari Kusanagi, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/998,235

(22) Filed: Nov. 24, 2004

(65) Prior Publication Data

US 2005/0162317 A1 Jul. 28, 2005

(30) Foreign Application Priority Data

Jan. 28, 2004 (JP) ..... 2004/019797

(51) Int. Cl.
*H01Q 1/38* (2006.01)

(52) U.S. Cl. ..... 343/700 MS; 343/846; 343/702

(58) Field of Classification Search ..... 343/700 MS, 343/846, 702
See application file for complete search history.

(56) References Cited

U.S. PATENT DOCUMENTS

| | | | | |
|---|---|---|---|---|
| 6,542,124 | B1 * | 4/2003 | Yoon | 343/700 MS |
| 6,873,292 | B1 * | 3/2005 | Yoo et al. | 343/702 |
| 2002/0021185 | A1 * | 2/2002 | Atokawa et al. | 333/134 |
| 2002/0180650 | A1 * | 12/2002 | Pankinaho et al. | 343/702 |
| 2003/0193439 | A1 * | 10/2003 | Park | 343/702 |

FOREIGN PATENT DOCUMENTS

JP 2002-198725 A 7/2002

* cited by examiner

*Primary Examiner*—Trinh Vo Dinh
(74) *Attorney, Agent, or Firm*—Frishauf, Holtz, Goodman & Chick, P.C.

(57) ABSTRACT

An antenna device of the present invention includes a dielectric block having top and bottom surfaces and side surfaces, a ground conductor disposed on the bottom surface of the dielectric block, and a radiation element which is provided on the top surface and the side surfaces of the dielectric block.

4 Claims, 6 Drawing Sheets

COMPACT ANTENNA DEVICE

This invention claims priority to prior Japanese patent application JP 2004-19797, the disclosure of which is incorporated herein by reference.

BACKGROUND OF THE INVENTION

The present invention relates to an antenna device, in particular, to a compact antenna device suitable for receiving radio waves from an artificial satellite as well as ground waves.

Antenna devices using a GPS (global positioning system) have been well known as antenna devices for receiving radio waves from an artificial satellite (hereinafter referred to as satellite waves). This type of GPS antenna devices for vehicle-mounted communication terminals or mobile communication terminals are required to be miniaturized.

An example of the GPS antenna devices will be described with reference to FIG. 1. FIG. 1 shows an example of a compact flat patch antenna device. An antenna device 30 includes a dielectric block 31 comprising resin or a ceramic material and a radiation element 32 disposed on the top surface of the dielectric block 31. A ground conductor 33 is disposed on the bottom surface of the dielectric block 31. Further, a grounding substrate 34 is disposed under the bottom surface of the dielectric block 31 and is electrically connected to the ground conductor 33. This type of antenna device is disclosed in Japanese Patent Application Publication (JP-A) No. 2002-198725, for example.

Although not shown in the figure, a feeding point is usually set in the radiation element 32 in this type of antenna device. Further, a feeding conductor (not shown) is connected to the feeding point through a through-hole (not shown) provided in the dielectric block 31, the ground conductor 33, and the grounding substrate 34. The feeding conductor is derived from the bottom side of the grounding substrate 34.

FIGS. 2A and 2B show the matching frequency and vertical radiation pattern characteristics of the antenna device shown in FIG. 1. The matching frequency is 1.927 (GHz) and the gain is 2.372 (dBi).

Herein, the frequency of a satellite wave transmitted from a GPS satellite is about 1.575 (GHz). Therefore, by shifting the matching frequency of the antenna device having the characteristics shown in FIGS. 2A and 2B to the vicinity of 1.57 (GHz), a receiving characteristic for the satellite wave can be enhanced. In the conventional antenna devices, a dielectric material of high permittivity is used for a dielectric block or the size of dielectric block is set large in order to obtain a lower matching frequency.

However, the cost increases by using a high-permittivity material. On the other hand, by setting the size of dielectric block large, the entire antenna device also becomes large. This is against the requirement for miniaturization.

SUMMARY OF THE INVENTION

An object of the present invention is to obtain a lower matching frequency while keeping an entire antenna device compact.

Another object of the present invention is to obtain a lower matching frequency without changing the material of elements of an antenna device.

An antenna device of the present invention includes a dielectric block having top and bottom surfaces and side surfaces; a ground conductor disposed on the bottom surface of the dielectric block; and a radiation element which is provided on the top surface and the side surfaces of the dielectric block.

Preferably, the radiation element covers the entire top surface, and, on the side surfaces, extends from the top surface to a point little above the bottom surface, so that the radiation element is not in electrical conduction with the ground conductor.

Also, at least one slit may be provided in the radiation element on at least one of the side surfaces, the slit extending upward from the lower edge of the radiation element.

Further, a grounding substrate comprising a conductive material may be provided under the bottom surface of the dielectric block via the ground conductor.

Still further, an insulating layer may be disposed on the upper surface of the grounding substrate except the area corresponding to the ground conductor, and a conductor pattern is disposed on the insulating layer and one of the side surfaces of the dielectric block, extending to the vicinity of the lower edge of the radiation element disposed on one of the side surfaces, whereby feeding from the conductor pattern to the radiation element is performed by electromagnetic coupling.

DESCRIPTION OF THE PREFERRED EMBODIMENTS

Figure 3:
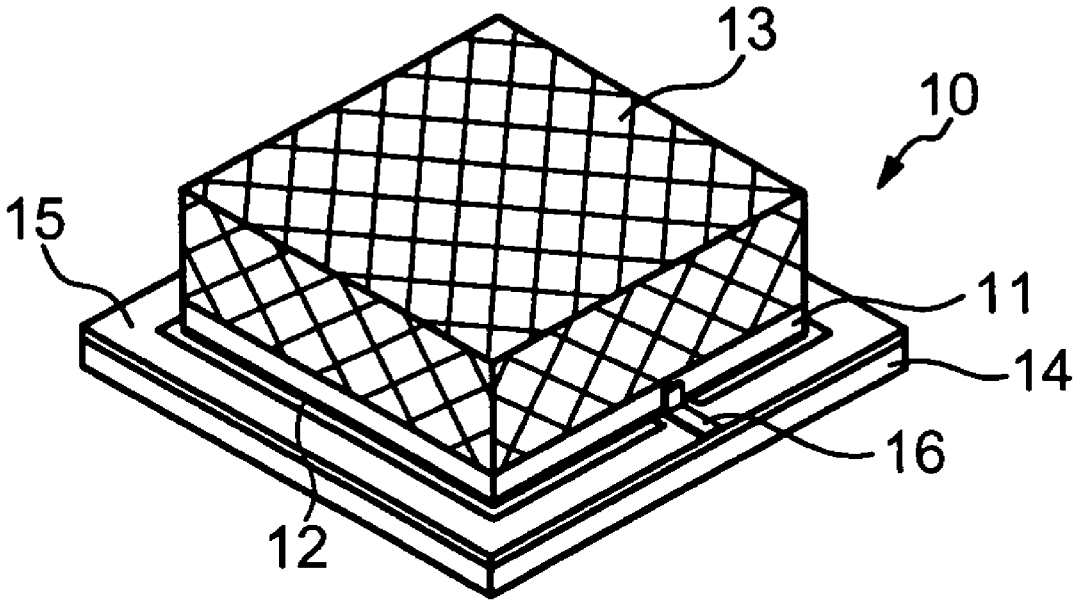
FIG. 3 is a perspective view of an antenna device according to a first embodiment of the present invention.

Hereinafter, an antenna device 10 according to a first embodiment of the present invention will be described with reference to FIGS. 3, 4A, and 4B. In FIG. 3, the antenna device 10 according to the first embodiment includes a dielectric block 11 having top and bottom surfaces and four side surfaces, a ground conductor 12 disposed on the bottom surface of the dielectric block 11, and a radiation element 13 which is provided on the top surface and the four side surfaces of the dielectric block 11. More specifically, the radiation element 13 covers the entire top surface of the dielectric block 11. Also, on the four side surfaces, the radiation element 13 extends from the top surface to a point little above the bottom surface, so that the radiation element 13 is not in electrical conduction with the ground conductor 12. Further, a grounding substrate 14 comprising a conductive material is disposed under the bottom surface of the dielectric block 11 via the ground conductor 12.

In this embodiment, an insulating layer (or an insulating film) 15 is disposed on the upper surface of the grounding substrate 14 except the area corresponding to the ground conductor 12. Further, a conductor pattern 16 extends on the insulating layer 15 and one of the side surfaces of the dielectric block 11, from an edge of the grounding substrate 14 to the vicinity of the lower edge of the radiation element 13 on one of the side surfaces of the dielectric block 11. The conductor pattern 16 is used for performing feeding to the radiation element 13 by electromagnetic coupling. For this purpose, the conductor pattern 16 is insulated so as not to be electrically connected to the ground conductor 12 and the grounding substrate 14.

Figure 1:
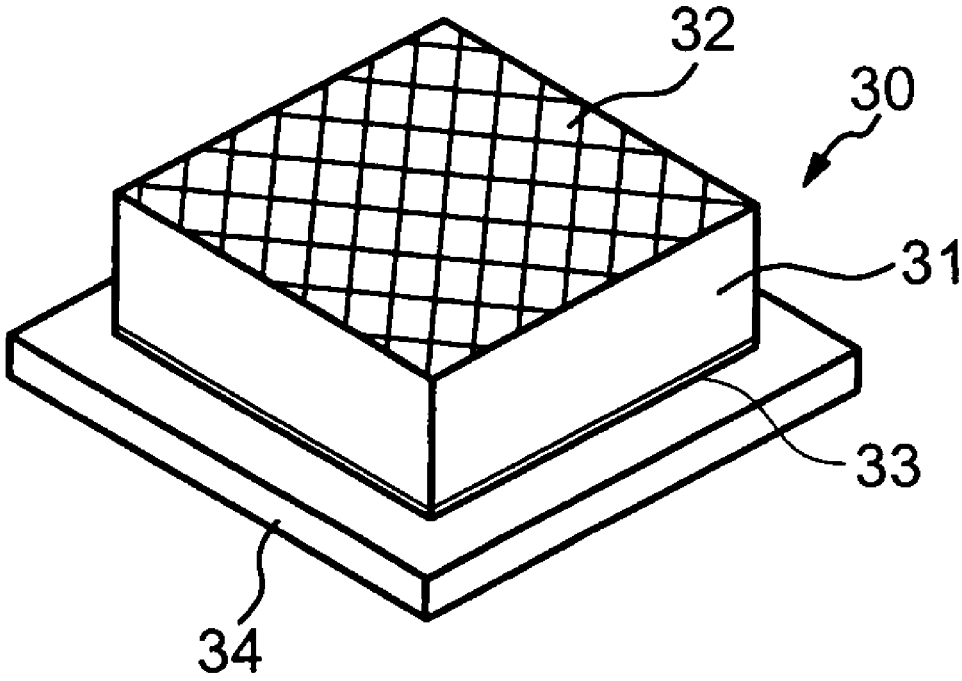
FIG. 1 PRIOR ART
FIG. 1 is a perspective view showing an example of a known antenna device.
Figure 2B:
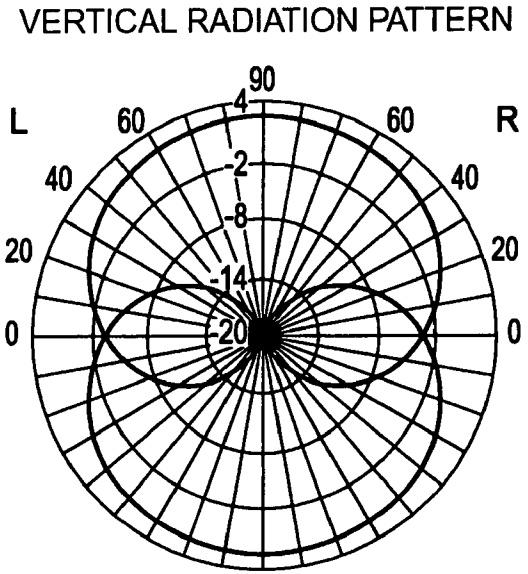
FIG. 2B PRIOR ART
FIGS. 2A and 2B show the matching frequency and vertical radiation pattern characteristics of the antenna device shown in FIG. 1.
Figure 2A:
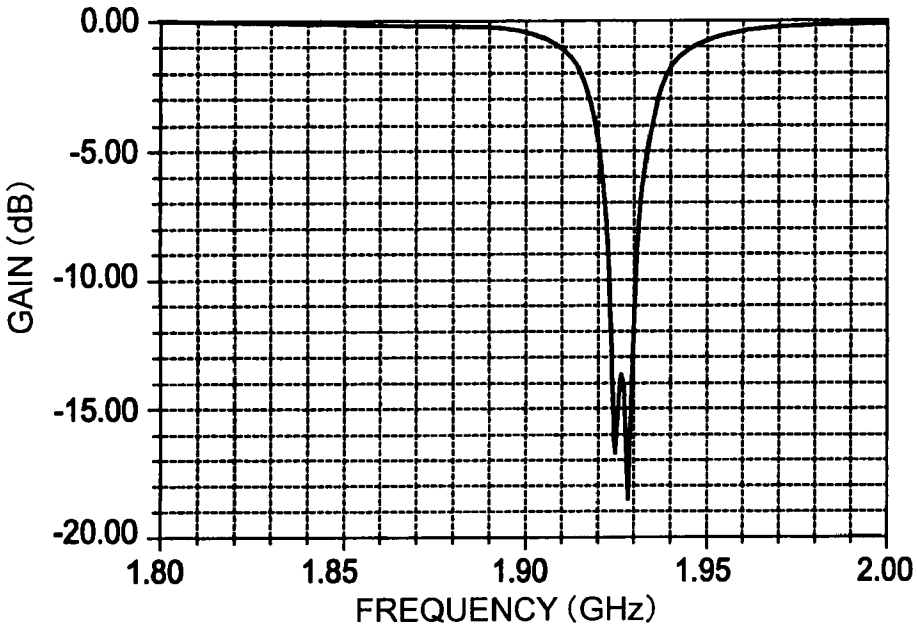
FIG. 2A PRIOR ART
Figure 4B:
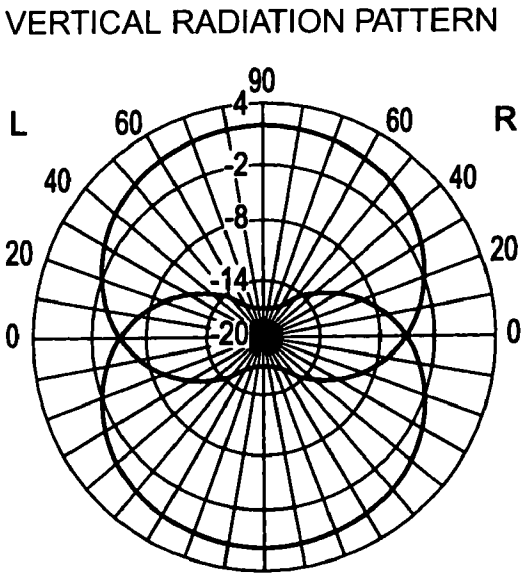
FIGS. 4A and 4B show the matching frequency and vertical radiation pattern characteristics of the antenna device shown in FIG. 3.
Figure 4A:
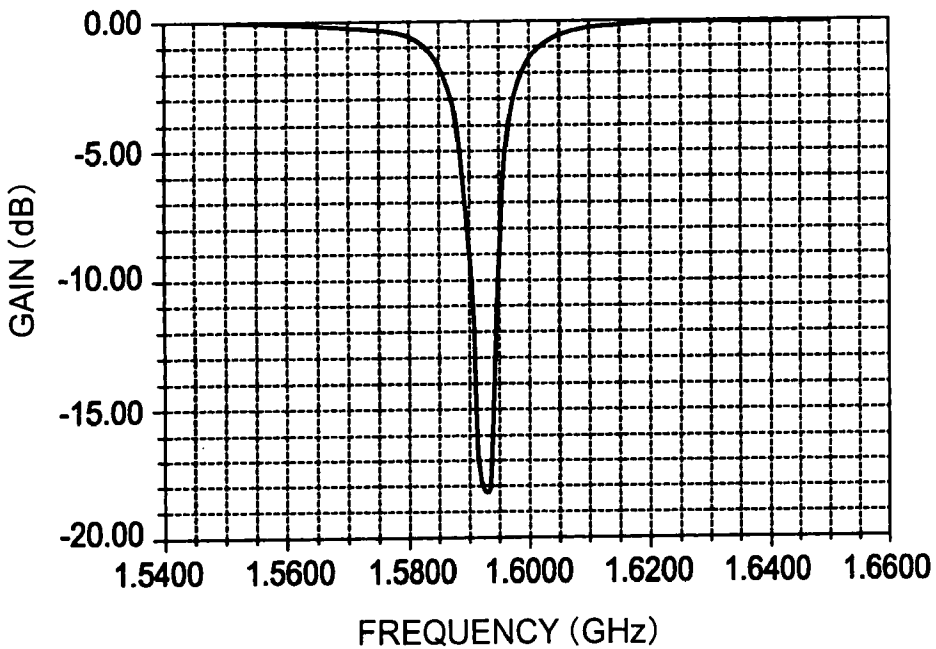

As described above, the radiation element 13 is provided on the entire top surface and almost the entire four side surfaces of the dielectric block 11, whereby a matching frequency of 1.59325 (GHz) and a gain of 1.857 (dBi) can be obtained, as shown in FIGS. 4A and 4B. In this case, the matching frequency is lower by 333.75 (MHz) than 1.927 (GHz) of FIG. 2A in the antenna device shown in FIG. 1. Of course, this lower frequency can be obtained without changing the size of the entire antenna device shown in FIG. 1.

Additionally, in the antenna device 10 according to this embodiment, the receiving characteristic at a low elevation angle, particularly, at a low elevation angle approximate to 0°, is slightly improved. This is apparent from the comparison between the radiation pattern according to the first embodiment shown in FIG. 4B and the radiation pattern shown in FIG. 2B of the antenna device shown in FIG. 1. Since the receiving characteristic at a low elevation angle is improved, the antenna device 10 of this embodiment can be effectively used as an antenna device for a recently-developed digital radio receiver for receiving satellite waves or ground waves, not as a GPS antenna device. This is because reception at a low elevation angle may be required in this type of digital radio receiver.

Figure 5:
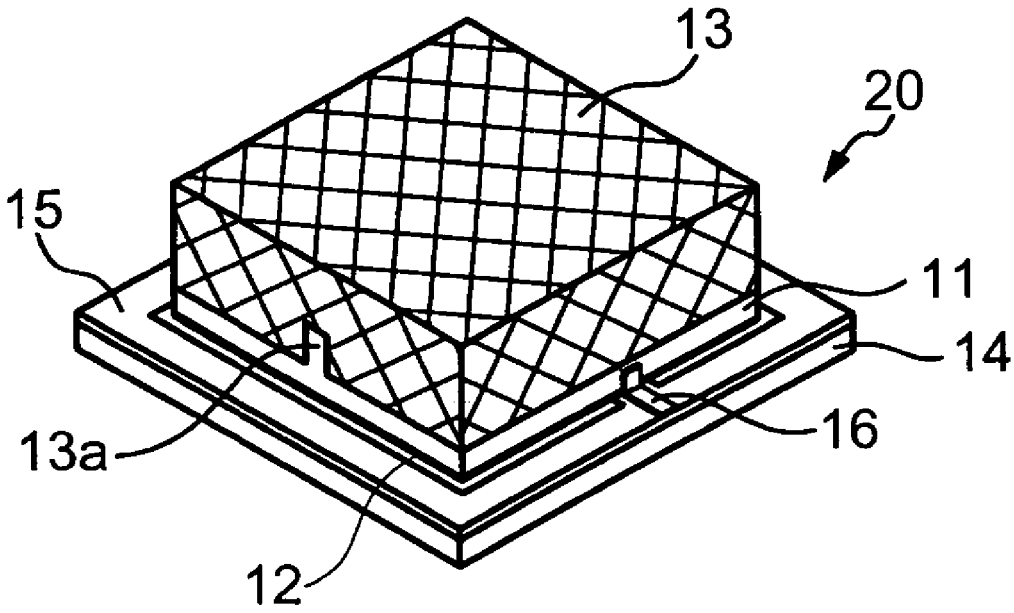
FIG. 5 is a perspective view of an antenna device according to a second embodiment of the present invention.

FIG. 5 shows an antenna device 20 according to a second embodiment of the present invention. The antenna device 20 according to the second embodiment is different from the antenna device 10 according to the first embodiment in the following terms. In this embodiment, a slit 13*a* is provided in the radiation element on each of the three side surfaces other than the side surface used for electromagnetic coupling with the conductor pattern 16, among the four side surfaces of the dielectric block 11. In FIG. 5, however, only one slit 13*a* on one side surface is shown. The slit 13*a* extends upward from the lower edge of the radiation element 13. The slit 13*a* may be provided in the radiation element on at least one side surface of the dielectric block 11. Alternatively, a plurality of slits may be provided in the radiation element on each of the side surfaces of the dielectric block 11 at regular intervals.

Figure 6B:
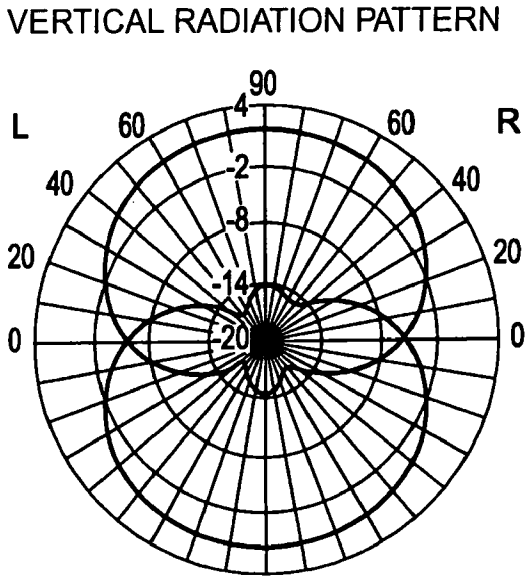
FIGS. 6A and 6B show the matching frequency and vertical radiation pattern characteristics of the antenna device shown in FIG. 5.
Figure 6A:
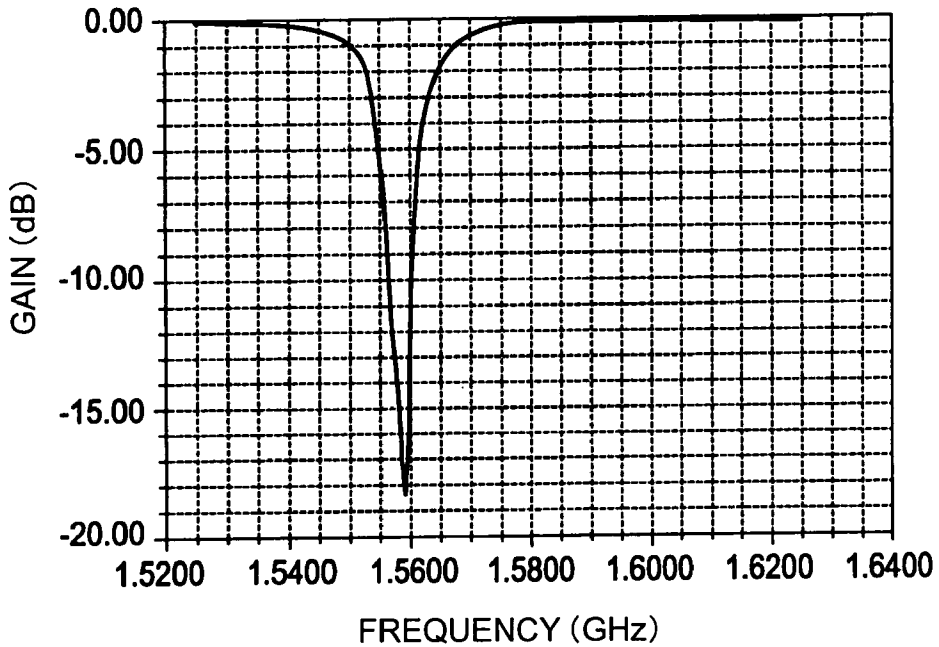

As described above, in the second embodiment, the radiation element 13 is provided on the entire top surface and almost the entire side surfaces of the dielectric block 11, and also one or more slits 13*a* are provided in the radiation element 13 on the side surfaces of the dielectric block 11. With this configuration, the antenna device 20 according to the second embodiment has a matching frequency of 1.55742 (GHz) and a gain of 1.601 (dBi), as shown in FIGS. 6A and 6B. In this case, the matching frequency is lower by 35.83 (MHz) than 1.59325 (GHz) in the antenna device 10 according to the first embodiment. Of course, this lower frequency can be obtained without changing the size of the entire antenna device shown in FIG. 1.

As described above, according to the present invention, a lower matching frequency can be obtained while keeping the entire antenna device compact. Also, a lower matching frequency can be obtained by using a general dielectric material, not by using a dielectric material of high permittivity. That is, according to the present invention, an antenna device having a lower matching frequency than that of the known antenna device can be realized while avoiding an increase in cost and satisfying the requirement for miniaturization. For example, the dielectric block 11 has a size of 15 mm×15 mm×6 mm. The radiation element 13 extends from the top surface of the dielectric block 11 to a point 2 mm above the bottom surface of the dielectric block 11.

The two preferred embodiments of the present invention have been described above, but the present invention is not limited to these embodiments. For example, the antenna devices described in the first and second embodiments are suitable for a GPS antenna device. However, the prevent invention is not limited to the GPS antenna device but may be applied to another type of compact antenna device for mobile communication terminals for receiving satellite waves or ground waves.

While this invention has thus far been described in conjunction with the preferred embodiments thereof, it will be readily possible for those skilled in the art to put this invention into practice in various other manners without departing from the scope of this invention.

What is claimed is:

1. An antenna device comprising:

a dielectric block having a top surface, a bottom surface, and side surfaces;

a ground conductor disposed on the bottom surface of the dielectric block; and a radiation element which is provided on the top surface and the side surfaces of the dielectric block;

wherein the radiation element covers the entire top surface of the dielectric block, and, on the side surfaces, extends from the top surface to a point above the bottom surface, such that the radiation element is not in electrical conduction with the ground conductor.

2. The antenna device according to claim 1, wherein at least one slit is provided in the radiation element in at least one of the side surfaces, and the slit extends upward from a lower edge of the radiation element.

3. The antenna device according to claim 2, further comprising a grounding substrate comprising a conductive material provided under the bottom surface of the dielectric block via the ground conductor.

4. The antenna device according to claim 3, wherein an insulating layer is disposed on an upper surface of the grounding substrate except in an area corresponding to the ground conductor, and a conductor pattern is disposed on the insulating layer and one of the side surfaces of the dielectric block so as to extend to a vicinity of the lower edge of the radiation element disposed on said one of the side surfaces, whereby feeding from the conductor pattern to the radiation element is performed by electromagnetic coupling.

* * * * *